United States Patent [19]

Pentney

[11] 4,000,832

[45] Jan. 4, 1977

[54] DISPENSING CONTAINERS

[75] Inventor: Harry Pentney, Reading, England

[73] Assignee: The Gillette Company, Boston, Mass.

[22] Filed: Apr. 15, 1975

[21] Appl. No.: 568,297

[30] Foreign Application Priority Data

Apr. 19, 1974 United Kingdom ..... 17365/74

[52] U.S. Cl. ..... 221/232; 206/354; 221/279; 30/40.2

[51] Int. Cl.[2] ..... B65D 83/10

[58] Field of Search ..... 221/232, 279, 251, 268; 30/40, 40.1, 40.2; 206/352–360

[56] References Cited

UNITED STATES PATENTS

| | | | |
|---|---|---|---|
| 2,291,187 | 7/1942 | Johnson | 221/251 |
| 2,679,685 | 6/1954 | Austin | 30/40.2 |
| 2,697,276 | 12/1954 | Austin | 221/232 X |
| 2,718,963 | 9/1955 | Austin | 30/40.2 X |
| 3,131,806 | 5/1964 | Tait et al. | 221/268 X |
| 3,834,018 | 9/1974 | Dawidowicz et al. | 30/40.2 |

*Primary Examiner*—Robert B. Reeves
*Assistant Examiner*—Joseph J. Rolla
*Attorney, Agent, or Firm*—Richard A. Wise; Oistein J. Bratlie; Scott R. Foster

[57] ABSTRACT

A dispensing container for shaving units, the shaving units being adapted for engagement with a razor handle, the container comprising a storage compartment for retaining a plurality of the shaving units, a wall structure for receiving and releasably retaining the head of a razor handle adapted to receive the shaving units, and a member facilitating movement of the shaving units out of the storage compartment and into engagement with the razor head, whereby a shaving unit can be withdrawn from the container by withdrawal of the razor.

5 Claims, 6 Drawing Figures

DISPENSING CONTAINERS

This invention relates to dispensing containers for replaceable shaving units of the type which comprise at least one blade and also a member, attached to the blade during manufacture and forming a permanent assembly therewith, which provides a guard surface for the cutting edge of the blade, the unit being adapted for ready engagement with and disengagement from a razor handle with which it is used for shaving, so that the unit as a whole can be replaced when the cutting edge of its blade becomes dulled.

The invention provides dispensing containers for such shaving units which are designed to protect the units during storage and transit and to allow the stored units to be coupled successively to a razor handle in a simple and reliable manner without risk of damage to the unit or the user.

In accordance with the invention a dispensing container for shaving units of the type herein defined comprises a storage compartment which contains a plurality of the units and has an outlet through which the units can be discharged singly in succession, and an assembly station adjacent the outlet from the storage compartment which is adapted to receive that part of a razor handle with which the units are releasably engageable and so to locate it that a unit discharged through the outlet will be delivered into assembled engagement with the handle.

Two particular embodiments of the invention are described below with reference to the accompanying drawings. More specific features and virtues of the invention will sufficiently appear from that description and the appended claims.

Figure 1:
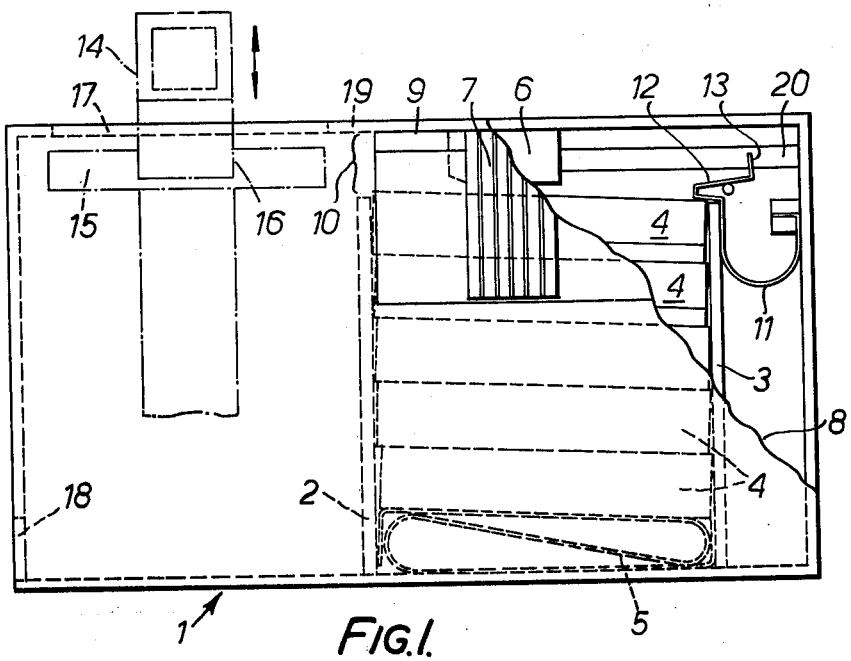
FIG. 1 is a plan view of one form of dispensing container with its top wall partly broken away, part of a cooperating handle being shown in broken lines.
Figure 2:
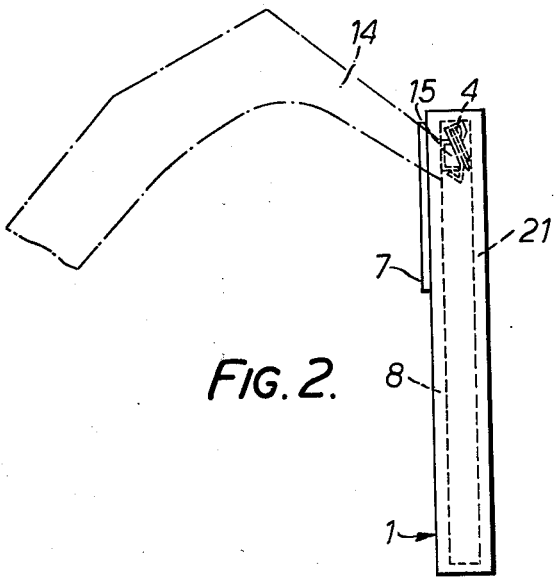
FIG. 2 is an end view thereof.
Figure 3:
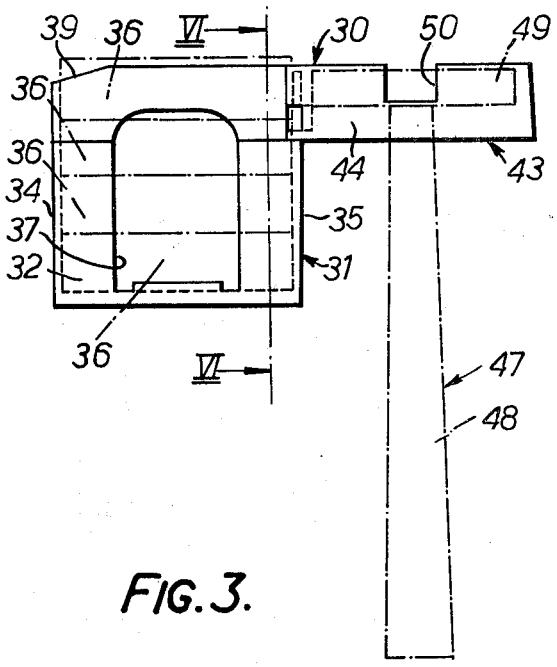
FIG. 3 is a front view of a second form of dispensing container, the positions of units to be dispensed and of a cooperating handle being shown in broken lines.
Figure 4:
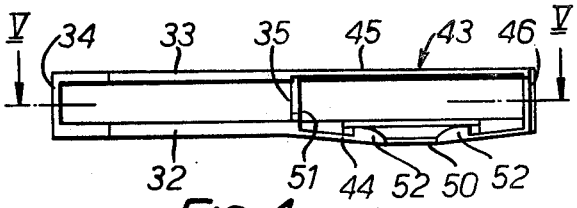
FIG. 4 is a plan view of the container of FIG. 3.
Figure 6:
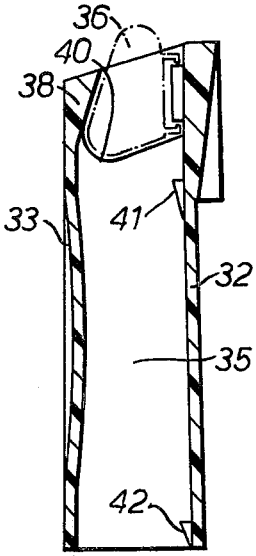
FIG. 6 is a section taken on the line VI—VI of FIG. 3, the position of one unit being indicated in broken lines.
Figure 5:
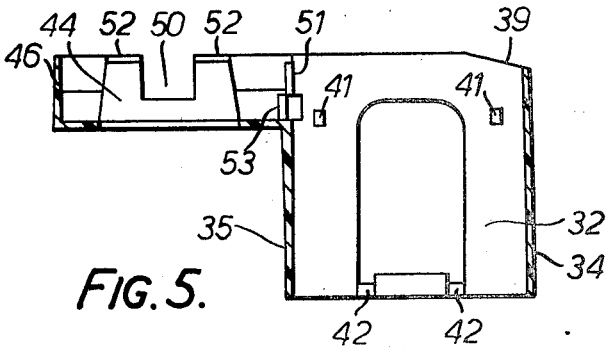
FIG. 5 is a section taken on the line V—V of FIG. 4.

The dispensing container shown in FIGS. 1 and 2 is intended for use with shaving units and razor handles of the character described in U.S. Pat. Nos. 3,703,764 and 3,768,162, but with suitable modifications it could be adapted to accommodate shaving units of another character. As illustrated, the container takes the general form of a shallow rectangular box 1 having a pair of internal partition walls 2 and 3 defining between them a storage compartment for shaving units 4. A generally Z-shaped leaf spring 5 in the storage compartment urges the units 4 towards the further end of the compartment, at which there is arranged a dispensing slide 6 movable laterally of the compartment by means of a handle portion 7 overlying the front wall 8 of the container, which wall is slotted at 9 to receive and guide a web, not shown, interconnecting the slide 6 and handle portion 7. The slide 6 is guided in a slideway 20 formed in the rear wall 21 of the container.

The partition wall 2 stops short of the end of the storage compartment so as to define, with the side wall 19 of the container, a dispensing opening 10. The partition wall 3 is of slightly shorter length than partition wall 2 and forms a stop for a latching spring having a U-shaped portion 11, a projecting nose portion 12 and a finger 13. The nose portion 12 normally projects over the end of wall 3 and acts as a stop for the adjacent unit 4, which is additionally restrained against movement under the influence of spring 5 by its engagement with slide 6.

To the left (as seen in FIG. 1) of partition 3 and aligned with dispensing opening 10 there is provided an assembly station for receiving and locating a razor handle 14, the end of which is provided with a rail 15 for receiving and retaining the shaving units 4. The handle is located in and by a recess 16 cut out of the front wall 8 to conform to the section of the upper handle of the razor and the adjacent side wall 19 is also cut away at 17 to permit withdrawal of the razor handle with a unit attached thereto in a direction generally longitudinally of the handle.

The remainder of the space to the left of partition 2 conveniently forms a receptacle for used units, which can be inserted through an opening 18 in one end wall or a suitable opening in the rear wall 21 or front wall 8 of the container.

In use, the razor handle ready to receive a shaving unit is located in recess 16. The slide 6 is moved fully to the right, as viewed in FIG. 1, engaging the finger 13 to draw the nose portion 12 of the latching spring clear of the adjacent unit 4; spring 5 is thus able to move the units 4 towards the side wall 19, thus aligning the endmost unit with the dispensing opening 10. Movement of the slide to the left causes it to engage the endmost unit, which is moved longitudinally through opening 10, and concurrently, the latching spring returns to its illustrated position to engage and retain the next unit. As the first unit moves through the opening 10 into the assembly station, it is slidably engaged with the support rail 15 of the razor handle, and only when it is assembled with the handle can the handle and unit be disengaged from the container by movement out of the recess 16 and cut-away 17.

In its extreme left hand position, the slide 6 still engages the next unit 4 in the storage compartment, which unit is therefore restrained by the slide and the latching spring until the slide is next moved to its opposite end position in readiness for a further dispensing operation.

With the arrangement described, the shaving units are inaccessible until fully assembled with the razor handle, and are not engageable by the handle without deliberate operation of the dispensing slide. The risk of accidental release of a unit is minimised by the latching spring, whose action must be overcome before the next unit can align itself with the dispensing opening. Even then, the spring 5 ensures a degree of frictional restraint mitigating against the unit sliding freely through the dispensing opening.

The dispensing container shown in FIGS. 3 to 6 is intended for use with shaving units and razor handles of the character shown in U.S. Pat. Nos. 3,703,764; 3,724,070; 3,786,563; and 3,832,774, but again it could readily be modified to suit units of another form. The container 30 comprises a generally rectangular storage compartment 31 having a front wall 32, a rear wall 33 and side walls 34 and 35, but open at the top and bottom. The storage compartment accommodates a plurality (as shown, four) of the shaving units 36, which are again arranged so as to extend in parallel, side-by-side arrangement across the width of the compartment. The faces of the shaving units on which the blades are exposed are directed rearwardly, so that the cutting edges are protected by the continuous rear wall 33 of the storage compartment. The front wall 32, however, is formed with an opening 37 which affords access to the reverse faces of the shaving units and allows the user to move each unit in turn to a position at the top of the storage compartment (shown occupied by one of the units) in which further upward movement of the unit is prevented by the forwardly inclined upper margin 38 of the rear wall 33. In this position the uppermost portion of the unit is exposed above the upper edges of the walls of the compartment 31 (the side wall 34 and the adjacent portions of the front and rear walls being cut away, as indicated at 39, to increase this exposure at one end of the unit) and the unit is aligned with a discharge outlet 40 formed in the upper part of side wall 35, through which it can then be displaced out of the storage compartment.

In the construction shown, the front wall 32 of the storage compartment is formed with a pair of ratchet teeth 41, which (due to the resilience of the material of which the container is made) will yield sufficiently to allow a shaving unit to be moved upwardly past them into the discharge position and will then engage below the unit to prevent its return. However, these teeth 41 may be omitted, in which case the user can readily exert sufficient upward pressure on the shaving unit to hold it aligned with the outlet 40 during the operation of moving the unit through the outlet.

The rear face of the front wall 32 is formed near its lower edge with another pair of ratchet teeth 42, which yield to allow shaving units to be introduced into the storage compartment through the open bottom thereof, but prevent escape of the units. This arrangement allows the storage compartment to serve also for the reception of used shaving units, since once the topmost unit has been discharged through the outlet 40, there will be room in the compartment for another unit. The introduction of the used unit also serves to advance the remaining units upwardly and to bring the uppermost of them into the discharge position. However, if desired, the storage compartment may be closed at the bottom, in which case ratchet teeth 42 can be omitted and, if desired, the container can be provided with a separate compartment for used units, as in the construction first described.

The dispensing container 30 also comprises a trough-like portion 43, which projects from the side wall 35 of the storage compartment 31 and constitutes an assembly station. The assembly station has front and rear walls 44, 45 formed respectively as integral continuations of the front and rear walls 32, 33 of the storage compartment and one end wall 46, the opposite end being constituted by the upper part of the side wall 35 of the storage compartment, in which the delivery outlet 40 is formed. The front wall 44 of the assembly station is shaped to receive, locate and support a razor handle 47 with which the shaving units are to be used. This handle comprises a stem or hand-grip portion 48 and a head 49 which extends transversely across one end of the stem and is of top-hat, or flanged-U, cross-section, so that it provides a pair of outwardly projecting rails adapted to engage slidingly with the grooves formed by a pair of undercut ribs on the shaving units. The wall 44 provides, internally of the assembly station, a recess which accommodates and locates the head 49 of the handle, the wall being cut away as indicated at 50 to accommodate the adjacent portion of the stem 48 and formed with a pair of lugs 52 for holding the handle securely in place.

To load a shaving unit into the handle, the user holds the dispensing container 30 in his left hand with the front and rear walls substantially vertical and with his right hand he lowers the head 49 of the handle through the open top of the assembly station and brings it into engagement with the cooperating recess in the front wall 44, the lugs 52 clipping over the head 49 and holding it correctly located for the reception of a shaving unit delivered from the storage compartment through the aperture 40, so that the user's right hand is now free. If the uppermost shaving unit is not already in position for delivery. it can readily be brought into position by upward pressure of the user's left thumb, applied to the shaving units through the openings 37 in the front wall of the storage compartment, this pressure being maintained, if necessary, during the delivery operation to maintain the shaving unit in correct alignment. Delivery of the shaving unit is effected by sliding it to the right with the right hand until the shaving unit is fully engaged with the head of the handle, excessive movement being prevented by the end wall 46 of the assembly station, and return movement being prevented by a ratchet tooth 53. If desired, however, this end wall may be omitted, so that the handle can be positioned in the assembly station while still holding a used shaving unit, the delivery of a fresh shaving unit as described above them serving also to displace the used unit and discharge it through the open end of the assembly station trough. When delivery has been completed, the handle with the unit correctly engaged therewith can be disengaged from the clips 52 and lifted out of the assembly station and is ready for use.

It will be appreciated that once the shaving unit has been partially engaged with the handle, the latter is held against removal from the assembly station until the shaving unit has been moved completely through the delivery aperture 40 into full and correct engagement. To reduce any risk of the handle being forcibly removed with a shaving unit only partially engaged therewith, the front wall 44 of the assembly station is formed, adjacent its junction with the storage compartment, with a projection 51 which engages between the undercut ribs of the shaving unit during the transfer of the unit from the storage compartment into engagement with the handle and thus positively prevents removal of the handle with an incorrectly fitted unit.

Having thus described my invention what I claim as new and desire to secure by Letters Patent of the United States is:

1. A dispensing container for shaving units of the type comprising a blade and a member permanently secured thereto which provides a guard surface, the shaving unit being adapted for engagement with and disengagement from a razor handle, said container comprising a storage compartment for retaining a plurality of said shaving units, means for facilitating movement of shaving units retained in said storage compartment, said storage compartment being provided with an opening through which said shaving units are movable successively, wall structure extending from said storage compartment and including an elongated front wall, an elongated rear wall and an end wall coupled to said front and rear walls at the outer extremities thereof, said front wall having a recess therein and means thereon for receiving and releasably retaining a head portion only of said razor handle, the remainder of said razor handle remaining outside of said container, and means facilitating longitudinal movement of said shaving unit through said opening and into engagement with said razor handle head portion, whereby one of said shaving units may be withdrawn from said container by withdrawal of said razor handle from said recess.

2. A dispensing container in accordance with claim 1 in which said means facilitating longitudinal movement of said shaving units through said opening comprises slide means manually reciprocable to push a shaving unit through the opening.

3. A dispensing container in accordance with claim 1, in which said means facilitating longitudinal movement of said shaving units through said opening comprises wall means exposing uppermost portions of said shaving units, said portions being surfaces of the shaving units other than surfaces on which cutting edges are exposed, whereby said shaving units may be successively engaged by a hand of an operator and manually pushed through said opening.

4. A dispensing container in accordance with claim 1, in which said means for facilitating movement of said shaving units in said storage compartment comprises spring means urging said shaving units towards a position in the storage compartment from which said units are movable longitudinally through said opening.

5. A dispensing container in accordance with claim 1 in which said means for facilitating movement of said shaving unit in said storage compartment comprises wall means having an aperture therein exposing said shaving units such that said units may be engaged by a hand of an operator and manually pushed towards a position in the storage compartment from which said units are movable longitudinally through said opening.

* * * * *